US011850200B2

(12) United States Patent
Jamesapollos

(10) Patent No.: US 11,850,200 B2
(45) Date of Patent: Dec. 26, 2023

(54) STRETCHING DEVICE TO RESTORE AND PROTECT AGAINST THE NEGATIVE EFFECTS OF PROLONGED SITTING

(71) Applicant: The Well Effect Company, Bedford, MA (US)

(72) Inventor: John Jamesapollos, Bedford, MA (US)

(73) Assignee: The Well Effect Company, Bedford, MA (US)

( * ) Notice: Subject to any disclaimer, the term of this patent is extended or adjusted under 35 U.S.C. 154(b) by 285 days.

(21) Appl. No.: 17/461,980

(22) Filed: Aug. 30, 2021

(65) Prior Publication Data

US 2021/0401656 A1 Dec. 30, 2021

Related U.S. Application Data

(63) Continuation-in-part of application No. 16/571,849, filed on Sep. 16, 2019, now Pat. No. 11,103,409, (Continued)

(51) Int. Cl.
*A61H 1/02* (2006.01)
*A63B 23/035* (2006.01)
(Continued)

(52) U.S. Cl.
CPC ..... *A61H 1/0244* (2013.01); *A61H 1/02* (2013.01); *A61H 1/0218* (2013.01); (Continued)

(58) Field of Classification Search
CPC ..... A61H 1/0244; A61H 2201/165; A61H 2201/1642; A61H 1/02; A61H 1/0218; A61H 1/0237; A61H 1/0292; A61H 2201/0192; A61H 2201/1238; A61H 2201/1253; A61H 2201/1676; A61H 2203/0468; A61H 2205/08; (Continued)

(56) References Cited

U.S. PATENT DOCUMENTS 2,777,439 A * 1/1957 Tuttle ..... A61H 1/02 601/33
3,724,450 A * 4/1973 Chaitin ..... A61H 1/02 482/904

(Continued)

*Primary Examiner* — Andrew S Lo
(74) *Attorney, Agent, or Firm* — Aspiro Legal, LLC; Jodi-Ann McLane

(57) ABSTRACT

The device and methods disclosed herein allow an individual to create and sustain a differential stretch to the anterior muscles and ligaments of the torso, hips and legs. The device includes a base frame, a vertical member secured to the base frame, a rotational lift lever secured to the vertical member at a pivot point, a lower extremity elevation member secured to the rotational lift lever, and at least one lower extremity attachment device secured to the lower extremity elevation member. In use, the device lifts an individual's legs above the ground, while the person is lying face down, so as to create a stretch in the anterior muscles, fascia, or ligaments. The device has various planes of rotation, allowing for differential stretching in various quadrants of the torso. The device is adjustable in height as well as displacement along a track within the base to accommodate different body types.

9 Claims, 4 Drawing Sheets

Related U.S. Application Data which is a continuation of application No. 15/703,231, filed on Sep. 13, 2017, now Pat. No. 10,449,104.

(51) Int. Cl.
*A63B 23/04* (2006.01)
*A63B 23/00* (2006.01)
*A63B 23/02* (2006.01)

(52) U.S. Cl.
CPC ..... *A61H 1/0237* (2013.01); *A61H 1/0292* (2013.01); *A63B 23/0216* (2013.01); *A63B 23/0233* (2013.01); *A63B 23/03525* (2013.01); *A63B 23/04* (2013.01); *A61H 2201/0192* (2013.01); *A61H 2201/1238* (2013.01); *A61H 2201/1253* (2013.01); *A61H 2201/165* (2013.01); *A61H 2201/1642* (2013.01); *A61H 2201/1676* (2013.01); *A61H 2203/0468* (2013.01); *A61H 2205/08* (2013.01); *A61H 2205/088* (2013.01); *A61H 2205/10* (2013.01); *A63B 2023/006* (2013.01)

(58) Field of Classification Search
CPC ..... A61H 2205/088; A61H 2205/10; A61H 2201/1215; A61H 2201/1664; A63B 23/04; A63B 23/0216; A63B 23/03525; A63B 23/0233; A63B 2023/00; A63B 21/4011; A63B 21/4013; A63B 21/4015; A63B 2023/006; A63B 2225/093
See application file for complete search history.

(56) References Cited

U.S. PATENT DOCUMENTS 4,232,662 A * 11/1980 Barber ..... A61H 1/0218 606/244
4,478,213 A * 10/1984 Redding ..... A61H 1/0214 601/26
5,203,755 A * 4/1993 Kaiser ..... A63B 23/0227 482/142
5,318,495 A * 6/1994 Malynowsky ..... A63B 22/00 482/129
5,449,336 A * 9/1995 Sabel ..... A63B 23/00 601/24
5,588,938 A * 12/1996 Schneider ..... A63B 24/00 482/7
6,261,250 B1 * 7/2001 Phillips ..... A63B 21/4013 482/121
6,932,778 B2 * 8/2005 Hirt ..... A61H 1/0237 601/29
8,784,284 B1 * 7/2014 Smith ..... A47D 13/046 482/121
10,449,104 B2 * 10/2019 Jamesapollos ..... A61H 1/0218
10,456,614 B1 * 10/2019 Dube ..... A63B 24/0062
10,576,325 B2 3/2020 Tedesco
10,926,123 B2 2/2021 Lear et al.
2002/0016240 A1 * 2/2002 Conner ..... A63B 21/4033 482/125
2002/0183176 A1 * 12/2002 Read ..... A63B 22/0007 482/148
2005/0049124 A1 * 3/2005 Xieh ..... A63B 23/0216 482/142
2005/0130814 A1 * 6/2005 Nitta ..... A63B 1/00 482/121
2005/0130815 A1 6/2005 Abdoli-Eramaki
2006/0229167 A1 10/2006 Kram et al.
2008/0182730 A1 * 7/2008 Conley ..... A61H 1/0244 482/95
2009/0258767 A1 * 10/2009 Foucault ..... A63B 21/4013 482/111
2009/0258768 A1 10/2009 Clarke
2009/0325768 A1 * 12/2009 Wessels ..... A63B 21/4015 482/140
2010/0216616 A1 * 8/2010 Jennings ..... A63B 21/4015 482/142
2010/0279832 A1 * 11/2010 Conley ..... A61H 1/0244 482/142
2013/0225378 A1 * 8/2013 Burek ..... A63B 26/00 482/142
2014/0073496 A1 * 3/2014 Bannerman ..... A63B 21/0552 482/139
2015/0314157 A1 * 11/2015 Lampert ..... A63B 21/4033 482/3
2015/0321339 A1 11/2015 Asbeck et al.
2017/0014666 A1 * 1/2017 Sather ..... A63B 21/4049
2017/0189748 A1 * 7/2017 Montgomery ..... A63B 21/4035
2018/0021614 A1 * 1/2018 Taft ..... A63B 23/0405 482/5
2018/0361200 A1 * 12/2018 Walker ..... A63B 21/4033
2019/0076691 A1 * 3/2019 Smith ..... A63B 23/1209
2019/0125610 A1 5/2019 Murakami et al.
2020/0155888 A1 5/2020 Tedesco
2020/0155891 A1 5/2020 Tedesco et al.

* cited by examiner

STRETCHING DEVICE TO RESTORE AND PROTECT AGAINST THE NEGATIVE EFFECTS OF PROLONGED SITTING

RELATED APPLICATIONS

This application is a continuation-in-part of U.S. patent application Ser. No. 16/571,849, filed Sep. 16, 2019, entitled STRETCHING DEVICE TO RESTORE AND PROTECT AGAINST THE NEGATIVE EFFECTS OF PROLONGED SITTING, which is a continuation of U.S. patent application Ser. No. 15/703,231, filed Sep. 13, 2017, entitled STRETCHING DEVICE TO RESTORE AND PROTECT AGAINST THE NEGATIVE EFFECTS OF PROLONGED SITTING both of which are incorporated herein by reference in their entirety

FIELD

The present invention relates to a device for re-balancing the body after prolonged or repetitive sitting or to use to prevent the unbalancing of the body in anticipation of prolonged sitting. More specifically, the present invention is directed toward a mechanism for differentially stretching the tighter, shorter anterior muscles and ligaments of a person's torso, while simultaneously not overstretching the longer, weaker posterior muscles and ligaments.

BACKGROUND

A common deleterious effect from prolonged or repetitive sitting is the differential effect on the person's body with respect to anterior and posterior muscles and ligaments. It is well understood that prolonged or repetitive sitting leads to tighter, shorter anterior muscles and ligaments in a person's body and a concomitant, but opposite, effect on the posterior muscles and ligaments, which are lengthened and weakened. Other activities of a repetitive or prolonged nature can cause a similar deleterious effect on a person's body because as muscles and ligaments around joints become imbalanced, posture and movement become affected leading to knee, hip, back, neck and shoulder pain. The most common causes of movement dysfunction and pain are the muscular and ligamentous imbalance and subsequent joint irritation that proceeds from these imbalances.

Numerous methods and treatments have been devised to treat muscle and joint pain. For example, U.S. Pat. No. 6,468,192 entitled "Frame for Body Stretching Exercises" describes a frame for stretching the upper and lower body as well as the abdominal muscles. See '192 patent Col. 3:43-4:5. The '192 patent is directed toward pre-exercise stretching as a means of avoiding injury and general stretching to enhance health. Id at Col. 1:10-21.

Similarly, U.S. Patent Publication No. 2005/0181917 entitled "Back Traction and Muscle Stretching Bench," describes an angled bench having a leg attachment, which is used to place an individual's back in traction. The force of the traction applied to the user's spine can be varied. The goal of the '917 patent publication is to provide a variety of traction, stretching, and exercise solutions for treating and preventing pain in the lumbar region. See '917 patent publication at Paragraph 0001.

In addition, international patent publication number WO 2013/102250 entitled "Gravity Assisted Spine Decompression Apparatus," discloses a device "designed to relax the user's back muscles as gravity safely and smoothly decompresses his/her thoracic and lumbar vertebrae while lying chest side on the apparatus; and same said apparatus being made reconfigurable to safely and smoothly decompress the user's cervical vertebrae while lying back side on the apparatus." See Abstract of '250 patent publication.

While each of these devices claim to provide relief for back pain, or aid in the stretching of abdominal or back muscles, each of these devices is designed to principally stretch the posterior muscles and ligaments of the body. None of these devices stretches the anterior muscles and ligaments, which is problematic because, the more we sit, the shorter the anterior muscles and ligaments become. It is therefore desirable to have a device that can stretch and elongate the anterior muscles and ligaments that become tight and protect the lax, weaker and longer posterior muscles that result from prolonged periods of sitting.

SUMMARY OF THE INVENTION

The inventive device and methods disclosed herein allow an individual to create and sustain a differential stretch to the anterior muscles and ligaments of the torso, hips and legs. The anterior muscles in these regions tend to be tighter and shorter in individuals who sit for more than brief intervals of time. The device is comprised of a base frame, a vertical member secured to the base frame, a rotational lift lever secured to the vertical member at a vertical pivot member, a lower extremity elevation member secured to the rotational lift lever, and at least one lower extremity attachment device secured to the lower extremity elevation member.

In methods of use, the device is used to lift an individual's legs off of the ground, while the person is lying face down, so as to create a stretch in the anterior muscles, fascia, or ligaments. The device has various planes of rotation, which allows for differential stretching in the various quadrants of the person's torso. In addition, the device is adjustable in height as well as displacement along a track within the base to accommodate different body types.

BRIEF DESCRIPTION OF THE DRAWINGS

Various aspects of at least one embodiment are discussed below with reference to the accompanying figures, which are not necessarily drawn to scale, emphasis instead being placed upon illustrating the principles disclosed herein. The figures are included to provide an illustration and a further understanding of the various aspects and embodiments and are incorporated in and constitute a part of this specification but are not intended as a definition of the limits of any particular embodiment. The figures, together with the remainder of the specification, serve only to explain principles and operations of the described and claimed aspects and embodiments, but are not to be construed as limiting embodiments. In the figures, each identical or nearly identical component that is illustrated in various figures is represented by a like numeral. For purposes of clarity, not every component may be labeled in every figure.

DETAILED DESCRIPTION

In physical therapy, a McKenzie approach uses press-up into extension whereby the person uses his or her arms to create a stretch to the anterior muscles and ligaments. While the McKenzie approach is quite effective, it does have several limitations. First, many people are unable to maintain a lack of tension in the body. Rather, the natural tendency is to use muscle tension to guard against the stretch, which essentially negates any positive stretching effect. In addition, many people's arms experience fatigue when attempting the MacKenzie approach. This fatigue prevents sustained engagement of the stretching. The present device facilitates passive stretching and solves these problems.

Figure 1A:
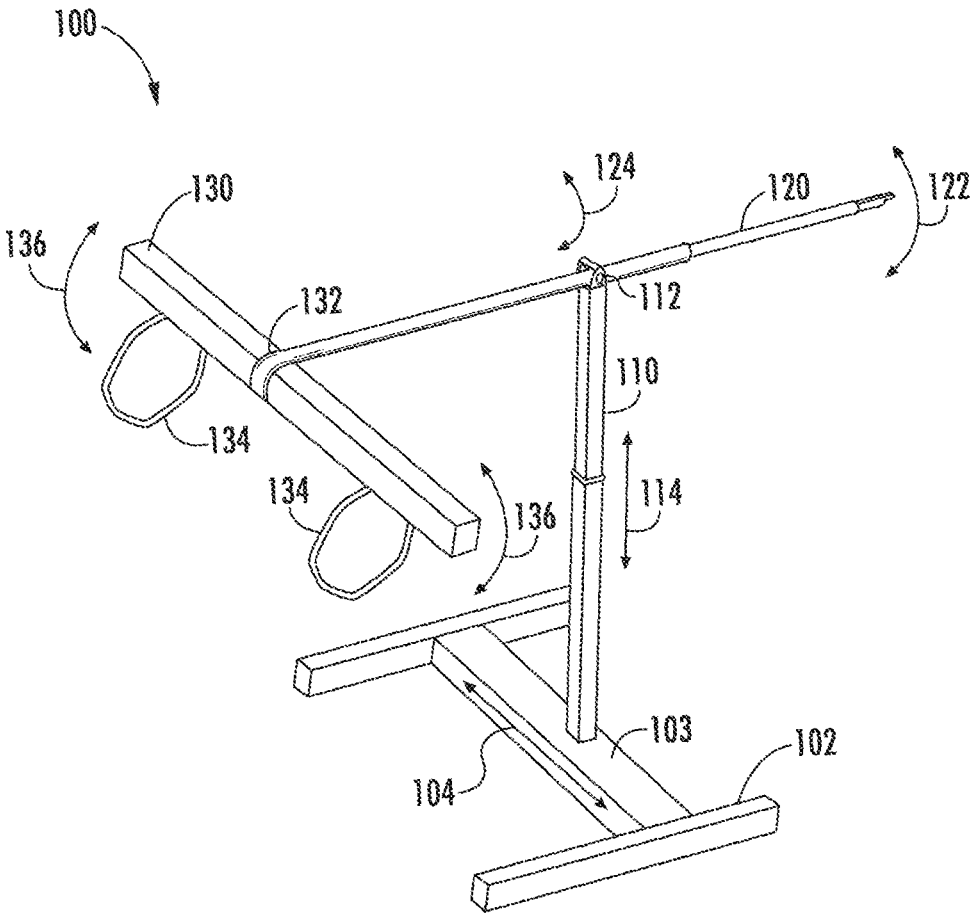
FIG. 1A is a side view of a manual device used to stretch at least one anterior muscle or ligament.
Figure 1B:
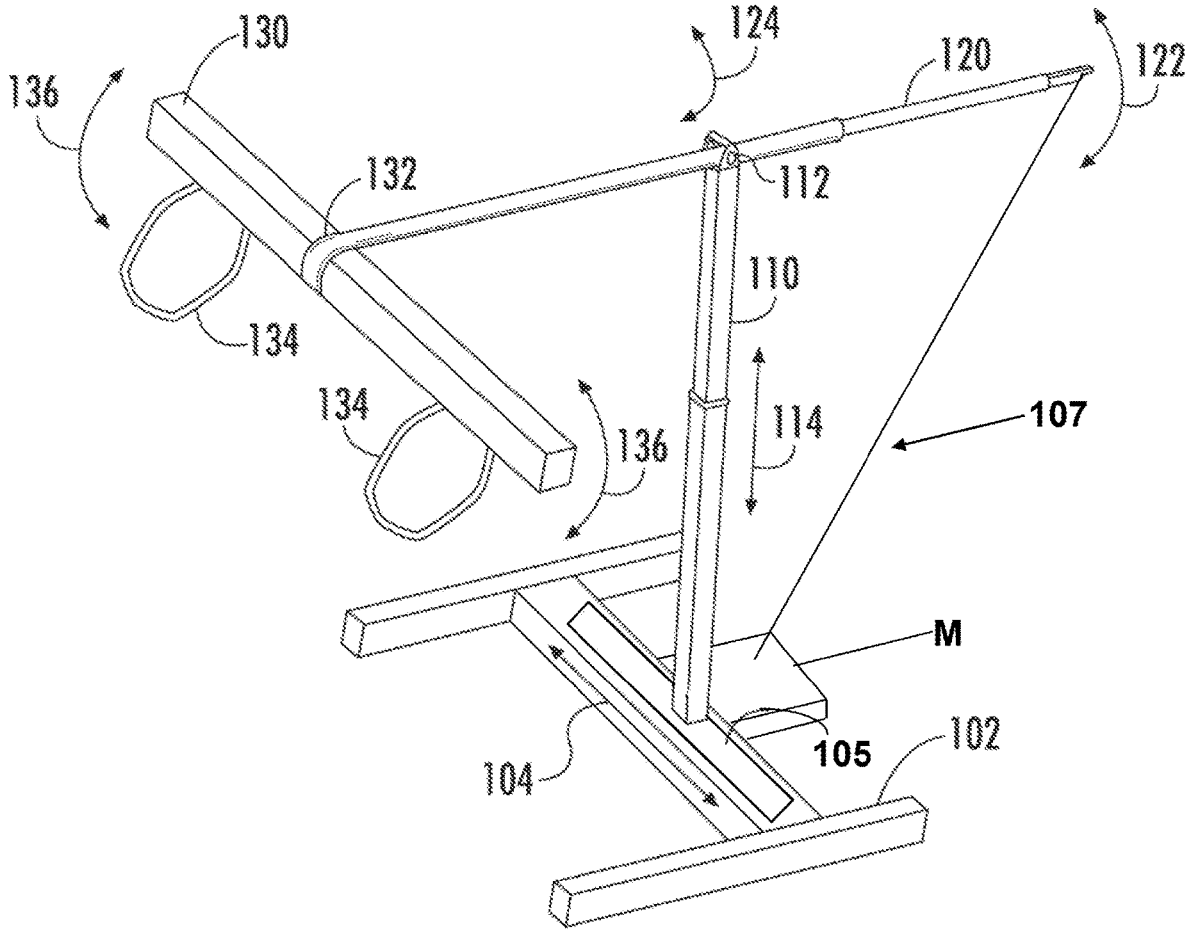
FIG. 1B is a side view of a motorized device used to stretch at least one anterior muscle or ligament.

FIGS. 1A and 1B depict a stretching device 100 described in various embodiments herein. Stretching device 1A is non-motorized, or manual, whereas the device illustrated in 1B is motorized. Motor "M" provides the power for movement of the motorized components described herein. Elements that are the same or substantially similar will be marked with the same numbers in both devices. Stretching devices 100 are comprised of a base frame 102 having a front and a rear end, a vertical member 110 secured to the base frame 102, a rotational lift lever 120 secured to the vertical member 110 at a vertical pivot member 112, a lower extremity elevation member 130 secured to the rotational lift lever 120, and at least one lower extremity attachment device 134 secured to the lower extremity elevation member 130.

In embodiments of the device 100, the vertical member 110 can be adjustable in height so as to accommodate different heights and weights of individuals using the device 100. The adjustment in height can be done manually, by a motorized track or hydraulic mechanism. Although FIG. 1B shows the motorized version, it may also include a combination of motorized and non-motorized components and need not be fully motorized. A change in height of the vertical member 110 is shown along a vertical axis 114.

Along those same lines, it may be advantageous to be able to move the vertical member 110 along a transverse axis 104 of the base frame 102. In some embodiments, this could be done to alter the force required to lift an individual's feet, for example, off of the ground. As illustrated in FIG. 1B, a motorized track 105 may be provided to move vertical member forward and backwards along base frame member 102. The motorized track 105 may include a pulley, screw drive, or other mechanical drive as would be known to those of skill in the art to move vertical member 110 side to side along the transverse axis 104.

Figure 2:
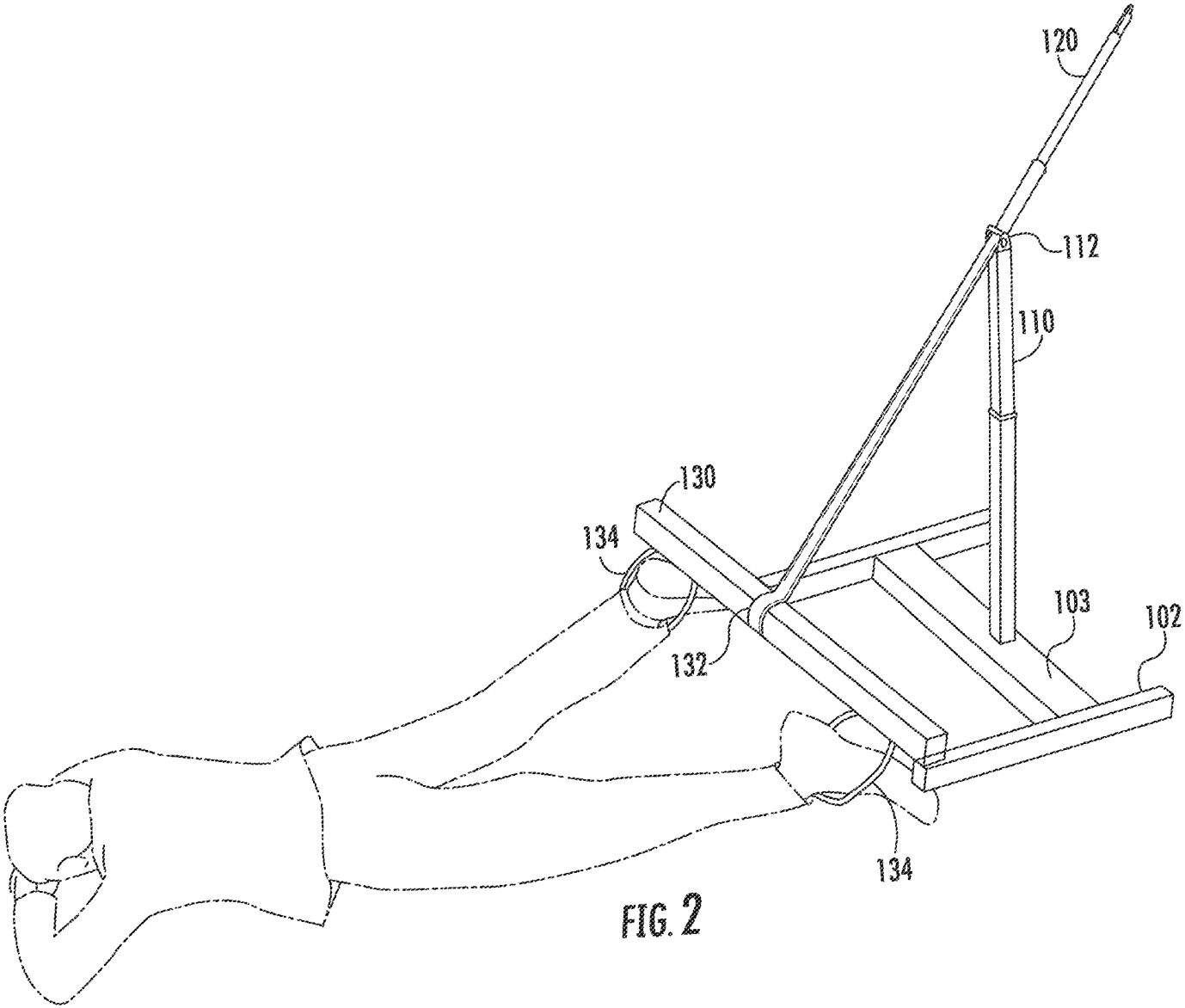
FIG. 2 is a side view of a person lying in a prone position prior to using the device embodiments of either FIG. 1A or 1B for stretching at least one anterior muscle or ligament.

Referring to FIG. 2, there is shown an individual using the device 100. According to methods of use disclosed herein, and for purposes of illustration regarding the functions of the elements of the device, FIG. 2 shows an individual in a prone position prior to stretching his/her anterior muscles. In order to obtain the stretching benefits of the device, the individual places his/her feet into the lower extremity attachment devices 134. Once his/her feet are secured within the lower extremity attachment devices 134, the rotational lift lever 120 can be lowered along a vertical axis 122 (FIGS. 1A & 1B) so as to increase the height of the lower extremity elevation member 130 with respect to the plane upon which the individual is lying. This can either be done by another person moving the device, such as a trainer, or through the individual activating a motorized cable 107 to shorten the length of the cable, thereby lifting the elevation member in an upward direction along vertical axis 122. Cable 107 is attached at one end to the lift member 120 and at the other end to motor "M." Activation can be done by remote control or through an app on a mobile device, as would be known to those of skill in the art.

Figure 3:
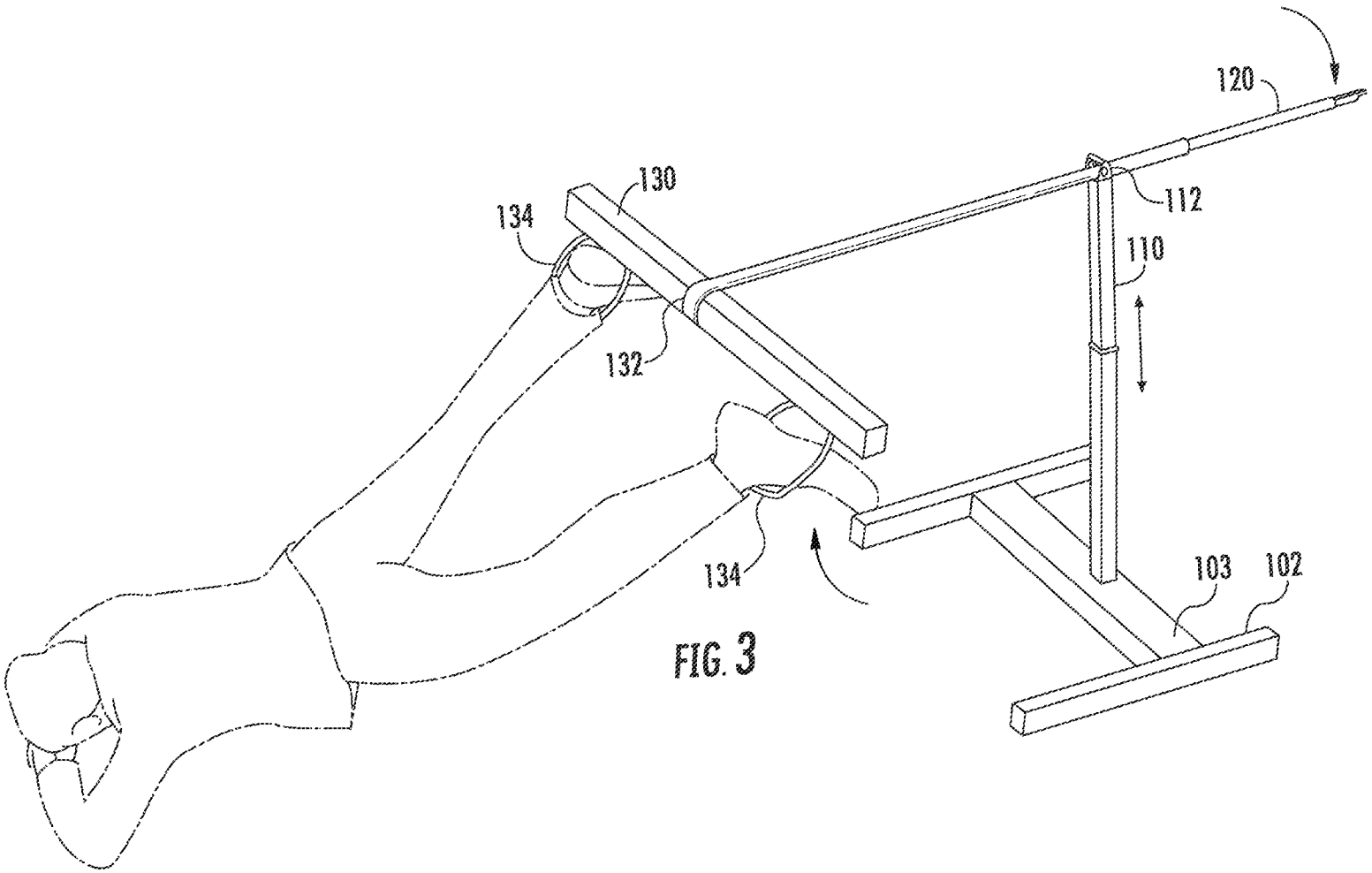
FIG. 3 is a side view of a person stretching at least one anterior muscle or ligament with the device embodiments of either FIG. 1A or 1B disclosed herein.

In this way, the individual is placed in a position that facilitates stretching of the anterior muscles and ligaments. FIG. 3 depicts such a stretch. In this stretch, it is desirable to raise the individual's feet off of the ground by at least 3 inches. The elevation height of the individual's feet can vary from 3 inches to over 40 inches depending on the individual's proportions and flexibility. In preferred methods of use, the individual's upper chest, arms, and head remain on the surface upon which the device 100 is located.

It may also be desirable to rotate the rotational lift lever 120 circumferentially 124 about a vertical pivot member 112 so as to provide a stretch that varies on alternate sides of the anterior muscles. For example, some individuals may be tighter on the left side of their interior muscles. Again, this can be done manually by a person assisting the individual being stretched, such as by a trainer, or through movement of the motorized cable 107.

Similarly, the lower extremity elevation member 130 could also be rotated circumferentially about the lower extremity pivot member 132. This type of rotation could increase the height of one foot with respect to another, as shown along axis 136. Again, this can be done manually by a person assisting the individual being stretched, such as by a trainer, or through motorization. In this embodiment, device 100 and methods of use thereof can create a bias to stretch one anterior quadrant preferentially over the other. This is accomplished by lifting one leg higher or lower than the other. Using the rotational aspects of these embodiments could address disparities in muscle, fascia, or ligament tightness.

In these embodiments, the vertical pivot member 112 and the lower extremity pivot member 132 could be a ball and socket, U-joint, a locking joint, or similar pivot means known to those of skill in the art.

In operation, the vertical member 120 could be lowered so that at least one extremity of a human body is lifted off of the ground by another human, for example a physical therapist, exercise coach, spouse, and so forth. In alternate embodiments, this step could be accomplished automatically via an automated system, as shown and described and including, for example, a hydraulic lift, which could be activated by the individual seeking the stretching benefits of the device 100.

In some embodiments configured for use with individuals who may have damaged or lost a lower extremity, there could be a means of compensating for the physics of lifting the individual into a stretching position. For example, one of the lower extremity attachment devices 134 could be configured to accept an additional weight to offset the imbalance created by the individual's asymmetry.

Those of skill in the art will recognize throughout this specification that when like terms are used to describe features and functionalities of various portions of a particular embodiment, those same features and functionalities could be present in additional embodiments having aspects with like terms.

The articles "a" and "an" as used herein in the specification and in the claims, unless clearly indicated to the contrary, should be understood to include the plural referents. Claims or descriptions that include "or" between one or more members of a group are considered satisfied if one, more than one, or all of the group members are present in, employed in, or otherwise relevant to a given product or process unless indicated to the contrary or otherwise evident from the context. The terms "coupled to" or "connected to" are intended to mean both a direct coupling or connection as well as a coupling or connection where there are one or more intermediary elements, devices, parts, and the like.

The invention includes embodiments in which exactly one member of the group is present in, employed in, or otherwise relevant to a given product or process. The invention also includes embodiments in which more than one or the entire group of members is present in, employed in or otherwise relevant to a given product or process. Furthermore, it is to be understood that the invention encompasses all variations, combinations, and permutations in which one or more limitations, elements, clauses, descriptive terms, etc., from one or more of the listed claims is introduced into another claim dependent on the same base claim (or, as relevant, any other claim) unless otherwise indicated or unless it would be evident to one of ordinary skill in the art that a contradiction or inconsistency would arise.

Where elements are presented as lists, (e.g., in Markush group or similar format) it is to be understood that each subgroup of the elements is also disclosed, and any element (s) can be removed from the group. It should be understood that, in general, where the invention, or aspects of the invention, is/are referred to as comprising particular elements, features, etc., certain embodiments of the invention or aspects of the invention consist, or consist essentially of, such elements, features, etc. For purposes of simplicity those embodiments have not in every case been specifically set forth in so many words herein. It should also be understood that any embodiment or aspect of the invention can be explicitly excluded from the claims, regardless of whether the specific exclusion is recited in the specification. The entire contents of all of the references (including literature references, issued patents and published patent applications and websites) cited throughout this application are hereby expressly incorporated by reference.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. Within this specification, embodiments have been described in a way which enables a clear and concise specification to be written, but it is intended and will be appreciated, that embodiments may be variously combined or separated without departing from the invention. It is intended that the present invention be limited only to the extent required by the appended claims and the applicable rules of law.

Additionally, the purpose of the Abstract is to enable the U.S. Patent and Trademark Office, and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the claims of the application nor is intended to be limiting on the claims in any way.

What is claimed is:

1. A device for stretching at least one anterior muscle in a human body comprising:

a base frame having a front end and a rear end;

a vertical member secured to the base frame;

a rotational lift lever secured to the vertical member at a vertical pivot member, the vertical pivot member being configured to support the rotational lift lever so that a front portion of the rotational lift lever extends forwardly of the vertical pivot member towards the front end of the base frame and a rear portion of the rotational lift lever extends rearwardly of the vertical pivot member towards the rear end of the base frame, wherein the rotational lift lever is vertically pivotal about the vertical pivot member;

a lower extremity elevation member secured to the front portion of the rotational lift lever;

at least one lower extremity attachment device secured to the lower extremity elevation member and configured to receive a foot of a user when the user is in a prone position;

a cable having a first end secured to the rotational lift lever, a second end operatively connected to a motor, and a resting length defined as the length of the cable between the first end and the second end when the motor is not activated; and wherein upon activation of the motor the resting length of the cable is shortened, so as to move the rotational lift lever downward and causing the front portion of the rotational lift lever to move upward as the rotational lift lever pivots about the vertical pivot member.

2. The device of claim 1, wherein the lower extremity elevation member remains substantially parallel to a top surface of the base frame as the front portion of the rotational lift lever moves upward to stretch the at least one anterior muscle of the user.

3. The device of claim 1, wherein the vertical member is adjustable in height.

4. The device of claim 1, wherein the base frame includes a track and is motorized to move the vertical member in a transverse direction along an axis of the base frame.

5. The device of claim 1, wherein the rotational lift lever is also circumferentially pivotal about the vertical pivot member by motorized movement of the cable.

6. The device of claim 2, wherein the lower extremity elevation member is secured to the rotational lift lever at a lower extremity pivot member.

7. The device of claim 6, wherein the lower extremity elevation member is rotationally pivotal about the lower extremity pivot member such that one end of the lower extremity elevation member can rotate upwardly during use such that the lower extremity elevation member is no longer parallel to the top surface of the base frame.

8. The device of claim 6, wherein the lower extremity elevation member is rotationally pivotal by motorized movement of the cable.

9. The device of claim 1, wherein the at least one lower extremity attachment device includes a first and a second lower extremity attachment device secured to the lower extremity elevation member such that the first and second lower extremity attachment devices both move upwardly as the lower extremity elevation member moves upwardly.

* * * * *